US007857310B2

(12) United States Patent
Yoshizawa

(10) Patent No.: US 7,857,310 B2
(45) Date of Patent: Dec. 28, 2010

(54) METHOD OF CONTROLLING A DICE GAME AND GAMING MACHINE

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 526 days.

(21) Appl. No.: 11/872,197

(22) Filed: Oct. 15, 2007

(65) Prior Publication Data

US 2008/0093798 A1 Apr. 24, 2008

(30) Foreign Application Priority Data

Oct. 24, 2006 (JP) ..... 2006-288688

(51) Int. Cl.
*A63F 9/04* (2006.01)

(52) U.S. Cl. ..... 273/146; 273/274

(58) Field of Classification Search ..... 463/10; 273/146, 274

See application file for complete search history.

(56) References Cited

U.S. PATENT DOCUMENTS 4,909,513 A * 3/1990 Kiyono ..... 463/22
5,263,715 A * 11/1993 Matsumoto et al. ..... 463/22
5,413,351 A 5/1995 Franklin
5,542,671 A * 8/1996 Stewart ..... 273/146
5,556,101 A * 9/1996 Jabro ..... 273/274
5,791,651 A * 8/1998 Bryant ..... 273/274
5,879,006 A * 3/1999 Bowling ..... 273/274
6,364,314 B1 * 4/2002 Canterbury ..... 273/274
6,394,901 B1 * 5/2002 Marta ..... 463/20
6,422,563 B1 * 7/2002 Fairchild et al. ..... 273/274
6,464,225 B1 * 10/2002 Webb ..... 273/274
6,508,469 B2 * 1/2003 Promutico ..... 273/274
6,609,710 B1 * 8/2003 Order ..... 273/148 R
6,805,352 B2 * 10/2004 Hunter ..... 273/274
RE39,770 E * 8/2007 Promutico ..... 273/274
2003/0075864 A1 * 4/2003 Swavy et al. ..... 273/146

(Continued)

FOREIGN PATENT DOCUMENTS

CN 1832787 A 9/2006

OTHER PUBLICATIONS

U.S. Appl. No. 11/872,212, filed Oct. 15, 2007, Yoshizawa.

(Continued)

*Primary Examiner*—Peter DungBa Vo
*Assistant Examiner*—Omkar Deodhar
(74) *Attorney, Agent, or Firm*—Oblon, Spivak, McClelland, Maier & Neustadt, L.L.P.

(57) ABSTRACT

A gaming machine includes a dice releasing unit, a game section, a player terminal, and a controller. The dice releasing unit sequentially releases a plurality of dice. The game section has a stopping plate that causes the dice released from the dice releasing unit to rest. The player terminal has a display through which a player can place a bet on predicted dots to appear on tops of the plurality of dice. The controller is configured with logic to (i) control the dice releasing unit to release the plurality of dice, (ii) control the player terminal so as to perform a bet operation, and (iii) control a payout of game media in accordance with an award. The controller receives, from the player terminal, a signal indicative of placing the bet on the predicted dots in combination with an order of release of the plurality of dice.

4 Claims, 10 Drawing Sheets

U.S. PATENT DOCUMENTS

| | | | | |
|---|---|---|---|---|
| 2003/0218300 | A1* | 11/2003 | Timmons, Sr. | 273/146 |
| 2004/0178575 | A1* | 9/2004 | Gaygen | 273/146 |
| 2004/0178580 | A1* | 9/2004 | Schwartz | 273/274 |
| 2006/0163807 | A1* | 7/2006 | Crenshaw et al. | 273/146 |
| 2006/0202416 | A1 | 9/2006 | Madden et al. | |
| 2007/0026930 | A1* | 2/2007 | Frost et al. | 463/17 |
| 2007/0029726 | A1* | 2/2007 | Ohira | 273/145 R |
| 2007/0040331 | A1* | 2/2007 | Scheb et al. | 273/274 |
| 2007/0060301 | A1* | 3/2007 | Lin | 463/22 |
| 2007/0075490 | A1* | 4/2007 | Gak | 273/146 |
| 2007/0138742 | A1* | 6/2007 | Pirouzkhah et al. | 273/146 |
| 2008/0079218 | A1* | 4/2008 | Morris et al. | 273/292 |

OTHER PUBLICATIONS

U.S. Appl. No. 11/875,118, filed Oct. 19, 2007, Yoshizawa.
U.S. Appl. No. 11/875,174, filed Oct. 19, 2007, Yoshizawa.

* cited by examiner

METHOD OF CONTROLLING A DICE GAME AND GAMING MACHINE

This application is based on and claims the benefit of priority from Japanese Patent Application No. 2006-288688, filed on 24 Oct. 2006, the content of which is incorporated herein by reference.

BACKGROUND OF THE INVENTION

1. Field of the Invention

The present invention relates to a method of controlling a dice game where a player predicts respective numbers of dots to appear on multiple thrown dice, and a gaming machine to accomplish the method of controlling a dice game.

2. Related Art

In general, various gaming machines including a dice gaming machine where a player places a bet on predicted numbers of dots to appear on multiple thrown dice are provided in game halls and casinos. Various rules and machines to play such dice games have been proposed. For example, a method of playing a dice game in which a player places a bet on a predicted outcome of a dealer's throw of dice and the dealer then throws the dice is disclosed in Patent Document No. 1. If a predetermined combination occurs, the player is entitled to throwing the dice, and has a chance to win a large amount of payout. In addition, SICBO in which a player places a bet on predicted numbers of dots to appear on three thrown dice is an old and familiar dice game.

SICBO is well known as an ancient Chinese dice game in which a player places a bet on predicted numbers of dots or a combination thereof to appear on three thrown dice. Ways of betting and odds are displayed on a player's table (these may be displayed using an image display unit). An area for placing a bet on a predicted number of dots to appear on a single die, an area for placing a bet on a same predicted number of dots to appear on two dice, an area for placing a bet on a same predicted number of dots to appear on three dice, an area for placing a bet on a predicted combination to appear on two dice, an area for placing a bet on a predicted total number of dots to appear on three dice, and the like are provided on the table. Odds cannot be uniformly determined due to regional or national conditions; however, these are typically set within a range from 1:1 to approximately 1:180 according to occurrence probabilities.

Patent Document No. 1: U.S. Pat. No. 5,413,351

The dice game proposed in the aforementioned Patent Document No. 1 is performed according to special rules. Therefore, there are disadvantages associated with unfamiliarity, and the game is lacks excitement, accordingly. On the other hand, the generally well-known SICBO can entertain players because of its familiarity; however, the types of betting are limited. Therefore, there is more room for improvement from the viewpoint of increasing interest. More specifically, in a bet area where an occurrence probability is low and odds are highest (approximately 1:180), a player may place a bet with excitement. However, in this bet area, the player simply predicts dots of the same size that will commonly appear on three dice, namely any one of combinations of the same number such as (1, 1, 1), (2, 2, 2), . . . and (6, 6, 6). For this reason, SICBO does not sufficiently allow a player to feel excited when she places a bet.

SUMMARY OF THE INVENTION

To solve the aforementioned problems, the present invention provides a method of controlling a dice game and a gaming machine allowing a further increase in interest of a player.

In an aspect of the present invention, a method of controlling a dice game is provided. The method includes the steps of: (a) sequentially rolling a plurality of dice; (b) allowing a player to place a bet on predicted dots to appear on tops of the plurality of dice in combination with an order of appearance of the dice; and (c) providing a predetermined award to the player when the bet placed in the step (b) is entitled to the award.

The method described above, in which the plurality of dice is sequentially released, allows the player to predict the dots to appear on the dice in combination with the order of the released dice. This results in an increase in the number of subjects on which the player places a bet. In other words, since the respective dots to appear on the sequentially released dice are specified, it is possible to increase the number of subjects for betting accordingly, compared with conventional methods with a plurality of dice of the same type. In this way, the method according to the present invention can allow the player to feel more excited.

In another aspect of the present invention, a method is provided, in which the plurality of dice are visually distinguishable from one another, and the step (b) further includes allowing the player to place a bet on predicted dots to appear on tops of the plurality of dice in combination with types of the dice.

With the method described above, it is possible for the player to specify respective types of the dice in addition to the order of the released dice. This results in an increase in types of betting. Specifically, in the case of three dice differing in colors, the probability to hit is 1/1296, when a bet is placed on the predicted order, dots and colors of the dice. Compared with SICBO in which prediction is performed for three dice of the same type, the method according to the invention can increase a payout ratio. In this way, the method allows the player to feel more amused in the game.

In still another aspect of the present invention, a gaming machine for a dice game is provided. The machine includes a dice releasing unit, a game section, a player terminal, and a controller. The dice releasing unit sequentially releases a plurality of dice. The game section has a stopping plate that causes the plurality of dice released from the dice releasing unit to rest. The player terminal has a display through which a player can place a bet on predicted dots to appear on tops of the plurality of dice resting on the stopping plate. The controller is configured with logic to (i) control the dice releasing unit to release the plurality of dice, (ii) control the player terminal so as to perform a bet operation, and (iii) control a payout of game media in accordance with an award. The controller receives, from the player terminal, a signal indicative of placing the bet on the predicted dots in combination with an order of release of the plurality of dice.

With such gaming machine, it is possible, for example, to arrange the player terminal, where the player participates in a game, around the game section lying at the center of a cabinet, in which the plurality of dice are released and caused to rest. The player can place a bet at the player terminal on predicted dots to appear on the tops of the plurality of dice sequentially released from the dice releasing unit. In addition, since the player can place a bet on the predicted dots to appear on the top of the dice in combination with the order of release of the dice, it is possible to increase the number of subjects for betting to be larger than that of a conventional gaming machine. In other words, since the dots to appear on the respective dice in combination with the order are specified, it is possible to increase the number of subjects for betting accordingly, compared with a gaming machine using a plurality of dice of the same type. In this way, the gaming machine according to the present invention allows the player to feel more expected.

In yet another aspect of the present invention, a gaming machine is provided, in which the plurality of dice are visually distinguishable from one another, and the controller further receives, from the player terminal, a signal indicative of placing a bet on the predicted dots to appear on the tops of the plurality of dice in combination with types of the dice.

With the gaming machine described above, it is possible for the player to specify the respective types of the dice in addition to the order of the released dice. This is followed by an increase in types of betting. Specifically, in the case of three dice differing in colors, the probability to hit is 1/1296, when a bet is placed on the predicted order, dots and colors of the dice. Compared with SICBO in which prediction is performed for three dice of the same type, the method according to the invention can increase a payout ratio. In this way, the method allows the player to feel more amused in the game.

In a further aspect of the present invention, a gaming machine is provided, in which the dice releasing unit includes a sensing portion that distinguishes the types of the plurality of dice sequentially released.

Since the gaming machine described above, in which the sensing portion distinguishes the order of the released dice in the dice releasing unit, it can cause the three dice to simultaneously tumble and to come to rest, so that a period of time required of a round of game can be decreased. In addition, as the dice differ in types, the player can effortlessly comprehend the order of the released dice.

In a still further aspect of the present invention, a gaming machine is provided, which further includes a detecting unit that detects dots to appear on the tops of the respective types of dice resting on the stopping plate. The controller executes payout processing for the player terminal in accordance with the dots detected by the detecting unit.

With such gaming machine, it is possible to promptly detect the dots to appear on the respective dice resting on the stopping plate as well as the order of the released dice. This enables prompt notification of game results to each player terminal.

According to the present invention, a method of controlling a dice game and a gaming machine are provided, which allows a player to feel more excited in the game.

DETAILED DESCRIPTION OF THE INVENTION

A dice game according to the present invention is configured so as to allow a player to place a bet on dots predicted to appear on tops of a plurality of dice in combination with the order of appearance, when the dice are sequentially rolled. When three dice are sequentially rolled, for example, the dice game allows betting for predicted dots to appear on a first die, a second die, and a third die. As described later, displaying chips in bet areas 61 and 62 on a bet table (second bet screen) shown in FIG. 1, for example, allows the player to place a bet on the predicted dots to appear on the dice in combination with the order of dice thrown into a game section.

A method of controlling a dice game and a gaming machine according to the present invention are described in detail below with reference to the attached drawings.

Figure 2:
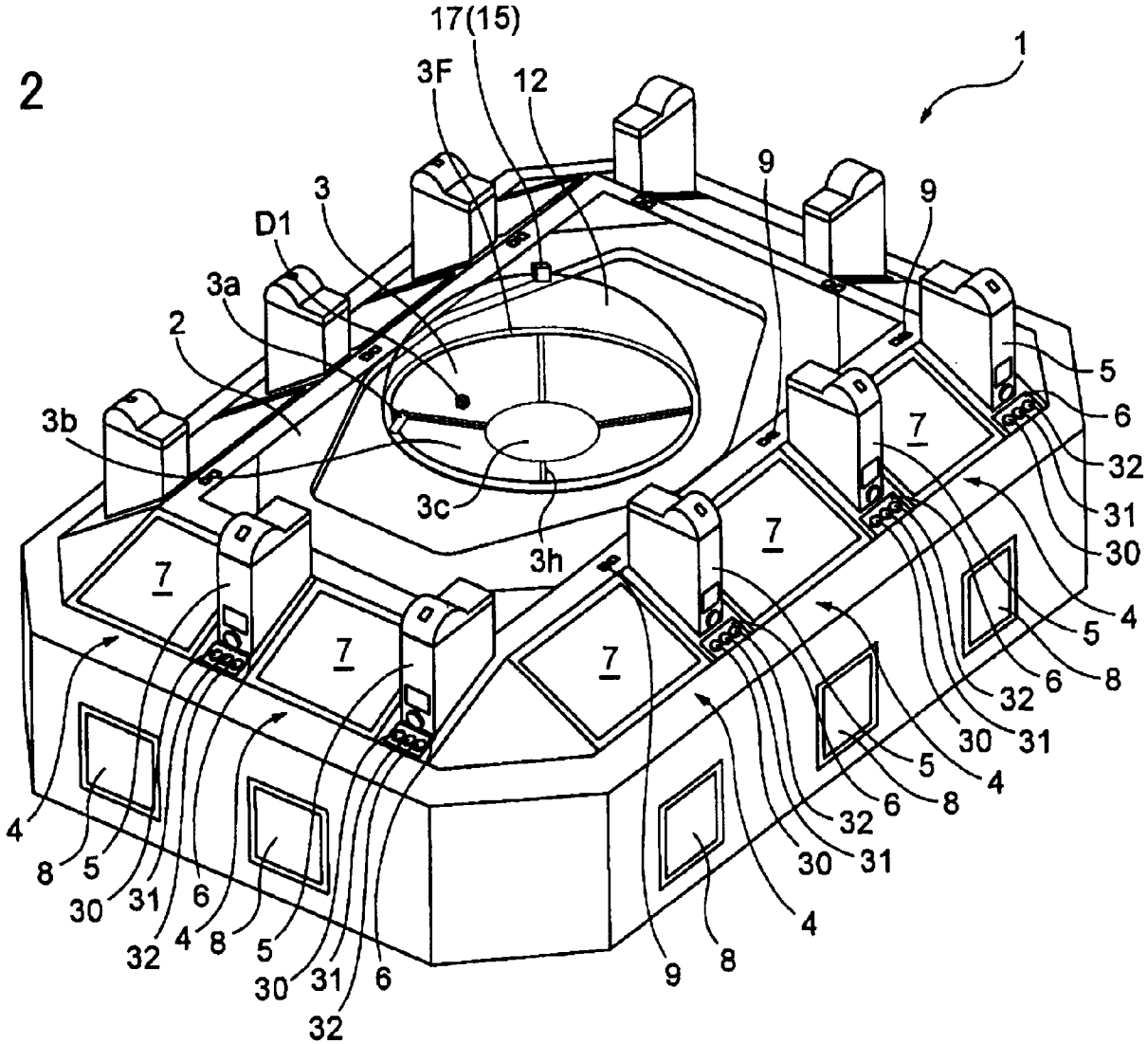
FIG. 2 is a perspective view showing an entire structure of an example of a gaming machine according to the present invention.
Figure 3:
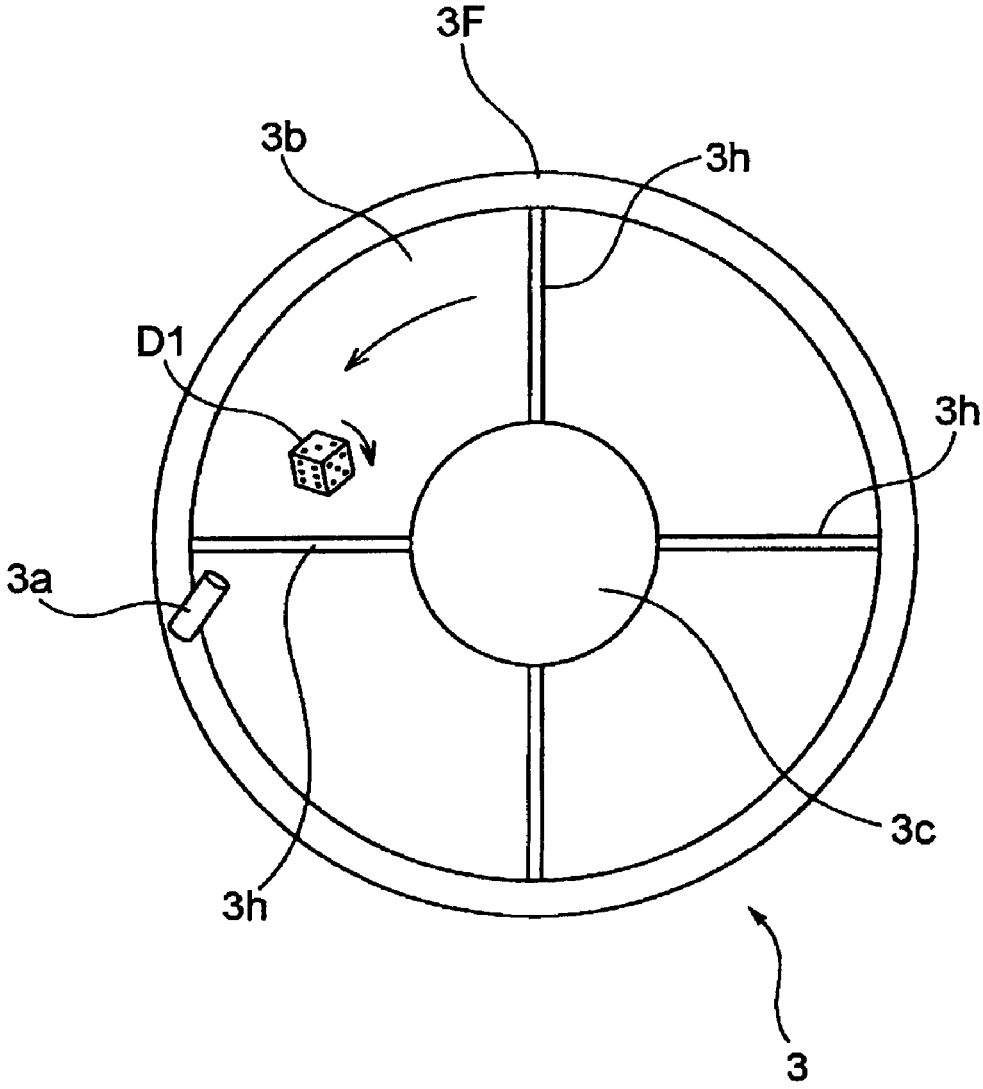
FIG. 3 is a plan view showing a configuration of a game section.
Figure 4:
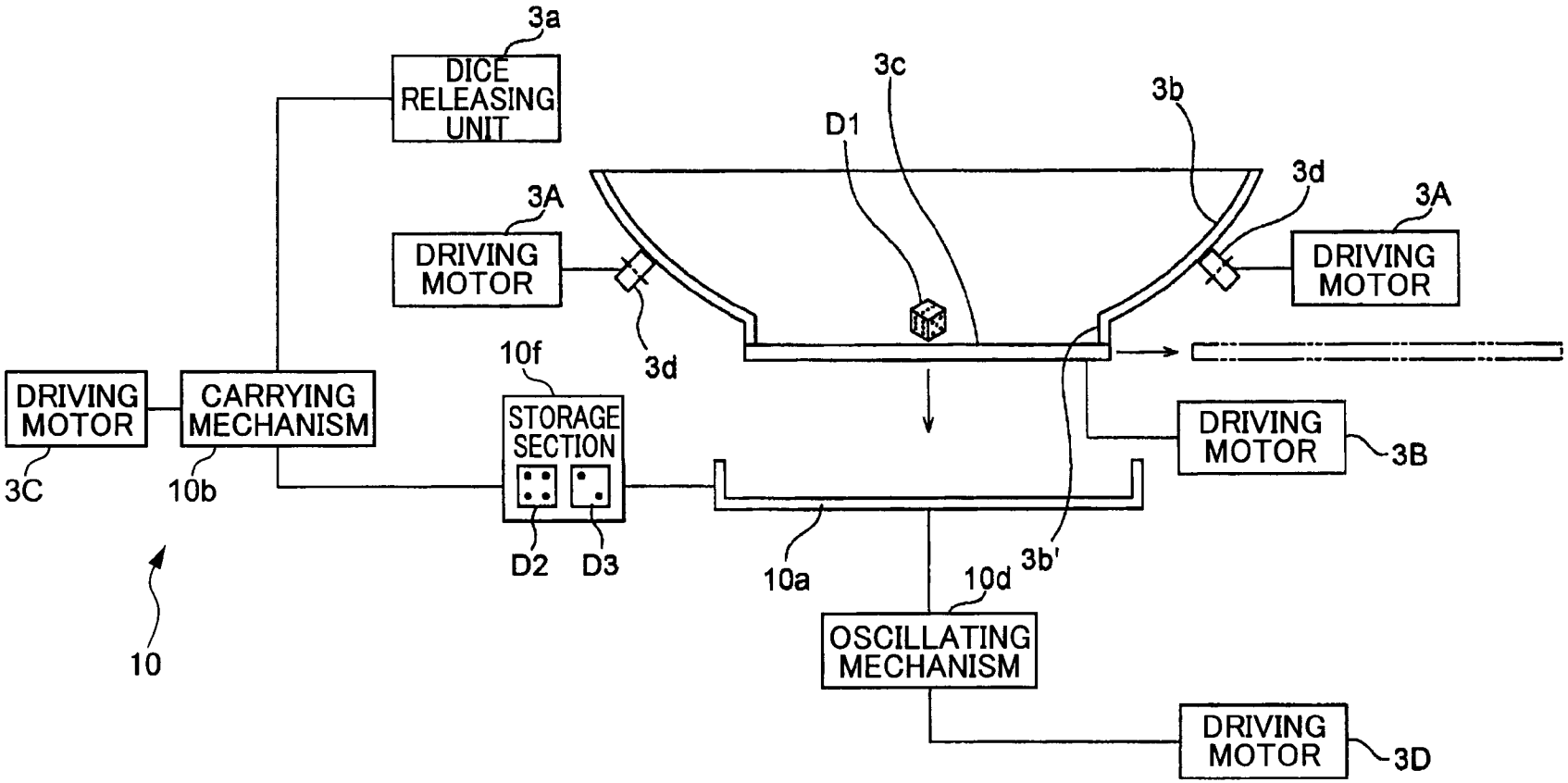
FIG. 4 is a diagram showing a schematic configuration of the game section.

FIG. 2 is a perspective view showing an embodiment of a gaming machine. FIG. 3 is an enlarged diagram of a game section (where multiple types of dice tumble and stop) of the gaming machine shown in FIG. 2. FIG. 4 is a diagram schematically showing a route from retrieval to release of the dice in the game section.

A gaming machine 1 includes: a cabinet 2, which is a main body; a dice game section 3 (hereafter referred to as a game section 3), which is provided substantially at the center of the top surface of the cabinet 2, and in which a plurality of dice are sequentially released, tumbled and stopped; and multiple (ten in this embodiment) player terminals 4, which are provided around the game section 3.

Each player terminal 4 should be configured so as to allow a player to bet, and include at least: a game media receiving device 5 into which game media such as coins or medals to be used for playing the game are inserted; a control unit 6, which is configured with multiple control buttons by which a player enters predetermined instructions; and an image display unit 7, which mainly displays images relating to a bet table during the game. The player may participate in a game, which is continuously played in the game section 3, by operating the control unit 6 or the like while viewing the image displayed on the image display unit 7.

In addition, payout slots 8, from which a player's game media are paid out, are provided on the sides of the cabinet 2 on which the player terminals 4 are provided. Moreover, a speaker 9 conveying music, sound effects, or the like is provided on the upper right of the image display unit 7 of each player terminal 4.

The game section 3 is configured so as to cause plural dice to be sequentially released and dots on the tops of the dice to be determined in order of release. In this connection, releasing of the dice simulates rolling thereof. In this embodiment, three dice D1, D2, and D3 are used in the game section 3, as with the conventionally well-known SICBO. A dice releasing unit 3*a* sequentially releases these dice.

In this case, the game section 3 handles the three dice D1, D2, and D3 as one set in one game. The game section 3 releases a first one of the three dice D1, D2, and D3, causes it to rest, identifies dots on top of it, and retrieves it. The game section 3 sequentially repeats the same operation for the second and third dice.

Although the three dice D1, D2, and D3 may be in a single color, they are differently colored so that bet operations by different colors (which are described later) can also be performed. It is possible to predict a type and dots for each of the three dice with the use of the three different colors.

The game section 3, which is shaped like a circle on the whole, includes a dice releasing unit 3*a*, a rotary plate 3*b*, and a stopping plate 3*c*. The dice releasing unit 3*a* sequentially releases the dice D1, D2, and D3. The rotary plate 3*b* tumbles the dice D1, D2, and D3 released by the dice releasing unit 3*a*. The stopping plate 3*c* ultimately causes the dice tumbling on the rotary plate 3*b* to rest.

The dice releasing unit 3*a*, which is provided on a circular outer frame 3F of the game section 3, releases the dice D1 to D3 one by one onto the rotary plate 3*b*. More specifically, the gaming machine 1 releases one of the dice, identifies dots on the top of it, and retrieves it. This type of operation is repeated three times for a game.

As illustrated in FIG. 4, the rotary plate 3*b* is formed in a so-called cone shape gently sloping inward down from the circular outer frame 3F, and is supported by multiple driving rollers 3*d*, which are in contact with the bottom of the rotary plate 3*b* so as to allow rotation. At a start of a game, rotary plate driving motors 3A rotationally drive the multiple driving rollers 3*d*, rotating the rotary plate 3*b*. It should be noted that since protrusions 3*h* are formed at predetermined intervals (e.g., formed so as to extend radially at substantially 90 degree intervals) on the surface of the rotary plate 3*b*, the dice are efficiently tumbled due to bouncing when the rotary plate 3*b* is rotationally driven.

In addition, the stopping plate 3*c* is a disk-like bottom of the cone-shaped rotary plate 3*b*, and is an area where a die D1 (D2 or D3) tumbling on the rotary plate 3*b* eventually comes to rest after falling along the slope thereof when the rotary plate 3*b* stops rotation. In other words, the die D1 (D2 or D3) released from the dice releasing unit 3*a* tumbles on the surface of the rotary plate 3*b* while the rotary plate 3*b* is rotating, falls along the sloping surface of the rotary plate 3*b*, and ultimately comes to rest on the stopping plate 3*c* when the rotary plate 3*b* stops rotation.

As illustrated in FIG. 4, a stopping plate driving motor 3B drives the stopping plate 3*c* to slide. When the stopping plate 3*c* is driven to slide, the die D1 (D2 or D3) falls toward a retrieve/release mechanism 10 while making contact with a contact section 3*b*', which is formed at the bottom of the rotary plate 3*b*.

The retrieve/release mechanism 10 includes: a receiving unit 10*a* which receives dice falling from the stopping plate 3*c*; a carrying mechanism 10*b* which stores one set of dice for a game within the receiving unit 10*a* and carries the set of dice to the dice releasing unit 3*a*; and a carrier driving motor 3C which drives the carrying mechanism 10*b*.

The retrieve/release mechanism 10 is not structurally limited as long as it is configured with the following functions: retrieving the dice from the dice releasing unit 3*a*; and releasing the dice to the rotary plate 3*b* after a detecting unit 15 to be described later detects dots on the tops of the dice resting on the stopping plate 3*c*. In other words, the carrying mechanism 10*b* may be implemented in various forms. For example, it may be possible to use air pressure, or a carrying mechanism such as a conveyer.

A transfer path of the carrying mechanism 10*b* has a storage section 10*f* in which the three dice D1 to D3 accumulated in the receiving unit 10*a* can be stored in a random manner. Specifically, when one die tumbles in the game section 3 and is retrieved into the receiving unit 10*a*, the carrying mechanism 10*b* extracts another die, which is to be released subsequently, from the dice stored in the storage section 10*f*, transferring the die to the dice releasing unit 3*a*.

It is preferable, but not necessary, that the receiving unit 10*a* that receives a die dropped from the stopping plate 3*c* is driven to oscillate by an oscillating mechanism 10*d* for a predetermined period of time. The receiving unit 10*a* described above allows the three dice to be shuffled prior to being stored in the storage section 10*f*. Thus, the three dice differing in colors can be randomly stored in the receiving unit 10*a*, and can be released from the dice releasing unit 3*a* with randomness. It should be noted that the oscillating mechanism 10*d* is driven by the driving motor 3D. The period of time to drive the driving motor 3D is randomly set for each game.

The top of the game section 3 is entirely covered with a cover 12 of hemispheric clear acryl to control the tumbling range of a die. In this embodiment, the detecting unit 15, which detects dots on the top of the die resting on the stopping plate 3*c*, is provided at the top of the cover 12.

Figure 5:
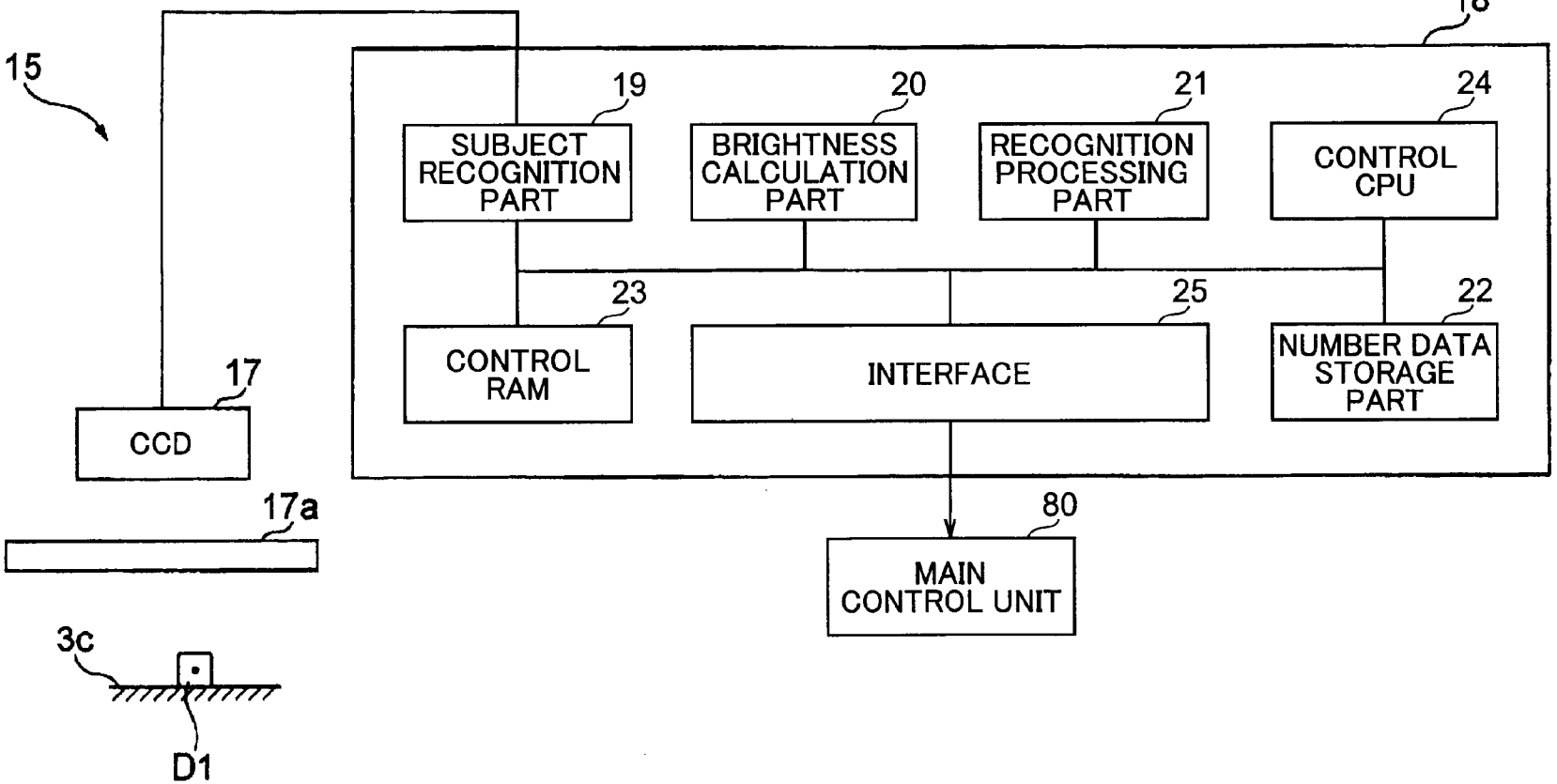
FIG. 5 is a block diagram showing an example of a detecting unit.

As illustrated in a block diagram of FIG. 5, the detecting unit 15 of this embodiment includes an imaging device (CCD camera) 17, which captures an image of a die or a subject, and a dots detection circuit 18, which processes an imaging signal sent from the imaging device 17 and detects dots on the top of the die.

The imaging device 17 is focused on the stopping plate 3*c* by a focus lens 17*a* so as to capture an image of the die on the stopping plate 3*c*, and is controlled for exposure. The dots detection circuit 18 includes: a subject recognition part 19, which receives imaging signals from the imaging device 17 and recognizes a position of the subject (die); a brightness calculation part 20, which calculates brightness of the subject image (die image) recognized by the subject recognition part 19; a recognition processing part 21, which determines dots on the top of the die; a dots data storage part 22, which stores comparison data regarding the dots on the top of the die; a control RAM 23; and a control CPU 24, which controls these units. These units are connected to each other via a bus, and each unit is configured so as to be controlled by the control CPU 24.

Figure 6:
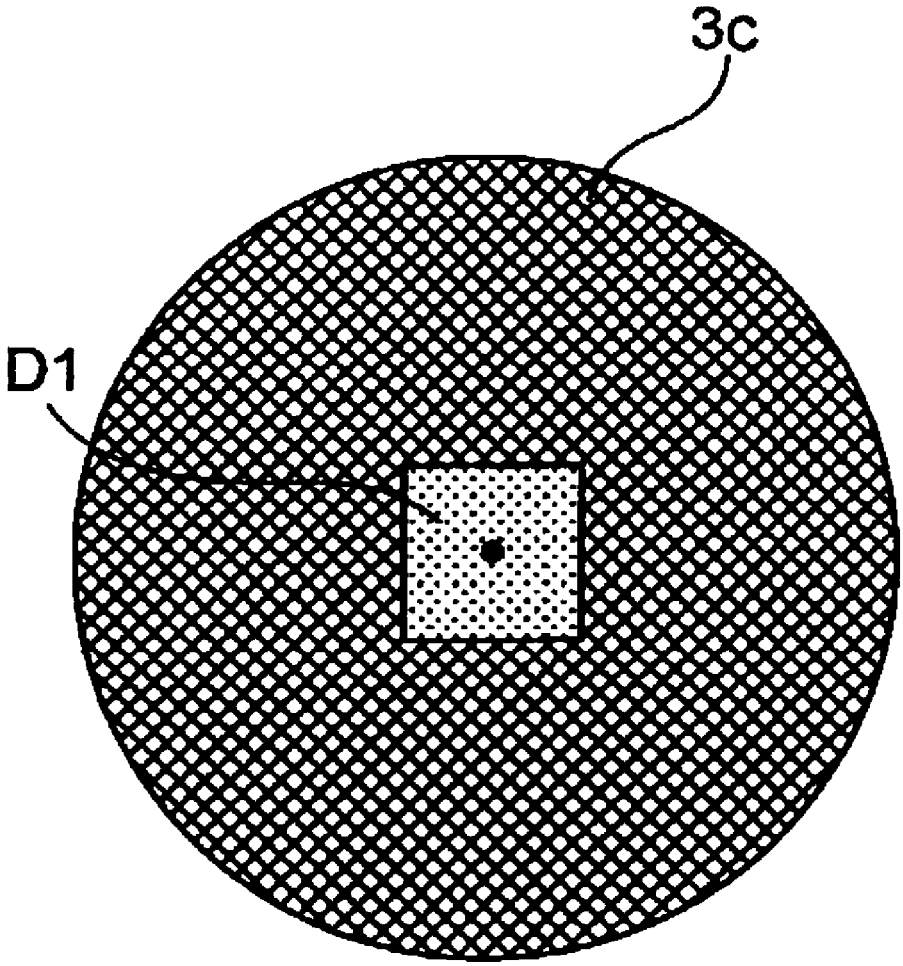
FIG. 6 is a diagram showing an exemplary image of a die obtained by the detecting unit shown in FIG. 5.

More specifically, the distribution in image intensity of the imaging signal of the die formed on the imaging device 17 is measured by the subject recognition part 19. As schematically illustrated in FIG. 6, the measurement of intensity distribution allows determination of the position (surface conditions) of the die D1 (D2 or D3) on the stopping plate 3*c*. The brightness calculation part 20 measures the brightness so as to determine a color of the die. In addition to the color, the recognition processing part 21 specifies the dots on the top of the die resting on the stopping plate 3*c* by performing a comparison with dots patterns (six types of dots combinations) previously stored in the dots data storage part 22.

As described above, the information related to the color and dots determined for the die is stored in the control RAM 23. The information is then transmitted to a main control unit 80, which is described later, via an interface 25, when the game media are paid out. In other words, the detecting unit 15 detects respective dots on the tops of the dice D1, D2, and D3, which come to rest in turn on the stopping plate 3*c*, and transmits the information to the main control unit 80 which controls the entire gaming machine.

In this way, the color of a dice and dots on the top of the dice are specified for each of the three dice, which are sequentially released by the dice releasing unit 3*a*.

The detecting unit 15 as described above is able to instantly detect dots on the tops of the dice resting on the stopping plate 3*c* in addition to an order of released dice. In this way, it is possible to promptly notify the respective player terminals 4 of game results. It should be noted that, when betting is not directed to the colors of the dice, the above-described three dice may alternatively be in a single color, or a single die may alternatively be used to perform the game.

Next, descriptions are given of the control unit 6 and the image display unit 7.

As illustrated in FIG. 2, the control unit 6 is provided at a side of the image display unit 7 of the player terminal 4, and includes buttons manipulated by a player. More specifically, a bet decision button 30, a payout button 31, and a help button 32 are provided in order, starting from the left as viewed from a position facing the player terminal 4.

The bet decision button 30 is a button provided for a player to press so as to confirm bets through the image display unit 7. If the confirmed bets are placed on dots matching those that appear on the tops of the dice in the game section 3, the player wins an award. When the player wins the award, credit corresponding to the number of bet chips is added to the current credit of the player based on the payout table.

The payout button 31 is a button which is usually pressed at the end of a game. When the payout button 31 is pressed, game media corresponding to the current credit that the player has acquired through the game is paid out from the payout slot 8.

The help button 32 is a button which is pressed by a player when she needs to know about a method of operating the game. Immediately after the help button 32 is pressed, a help screen showing various kinds of operation information are displayed on the image display unit 7.

Figure 7:
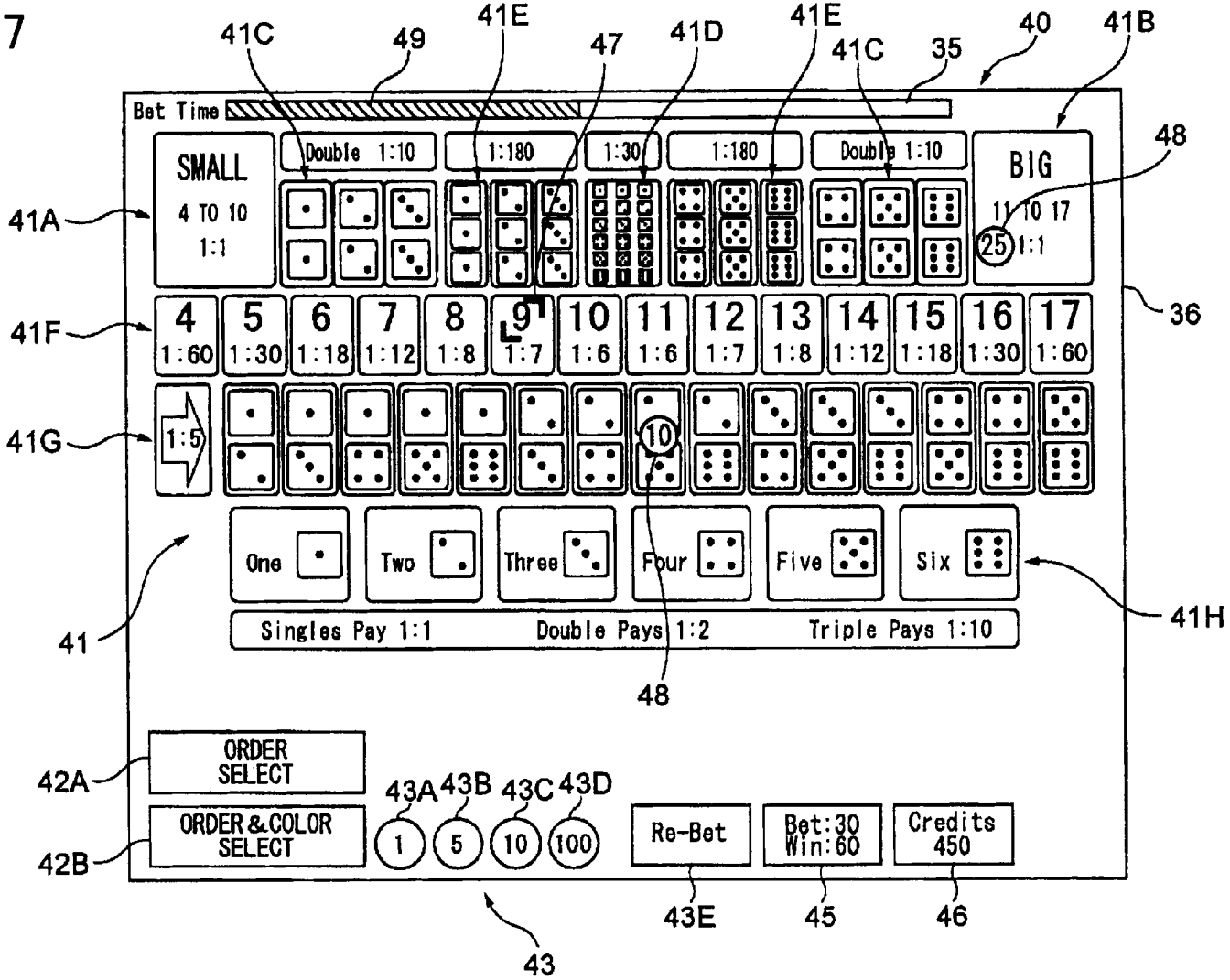
FIG. 7 is a diagram showing an exemplary display of a bet screen (first bet screen)

As illustrated in FIG. 7, the image display unit 7 is a so-called touch-panel liquid crystal display, on the front surface of which a touch panel 35 is attached, allowing a player to perform selections by pressing icons displayed on a liquid crystal screen 36.

It should be noted that FIG. 7 is a diagram showing an exemplary display screen displayed on the image display unit 7. As illustrated in this drawing, a table-type betting board (first bet screen) 40 for predicting dots that appear on the tops of the dice for a current game is displayed on the image display unit 7. It is possible for a player to place a bet using available credits while viewing the first bet screen 40 displayed on the image display unit 7.

A description in detail is now given of the first bet screen 40 described above. This first bet screen 40 is an example of a table through which a player places a bet on dots to appear on the tops of the three dice, which are sequentially caused to rest on the stopping plate 3*c*. In the first bet screen 40, betting is not directed to an order of release or colors of the dice.

The first bet screen 40 displays a bet area 41 in a grid, in which dice are displayed. The player places a bet by selecting a particular area in the bet area 41 through pressing (touching) the touch panel 35 so as to display a chip on the particular area.

Display selection button 42A and 42B for displaying a second bet screen 60 and a third bet screen 70, respectively, which are described later, a bet button unit 43, a payout result display area 45, and a credit count display area 46, are displayed at the bottom of the first bet screen 40 in order from the left side of the screen.

The player selects the display selection section 42A when she desires to place a bet on a predicted order of released dice and dots to appear on the tops of the dice. On the other hand, the player selects the display selection section 42B when she desires to place a bet on a predicted order of released dice, the colors thereof, and dots to appear on the tops of the dice. That is, when the player touches one of the display selection sections 42A and 42B, the first bet screen 40 is switched to one of the second and the third bet screens 60 and 70. In this way, the player can place a bet on the different combinations described above.

The bet button unit 43 is a group of buttons that are used by a player to bet chips on the specified bet area 41. The bet button unit 43 includes a 1 bet button 43A, a 5 bet button 43B, a 10 bet button 43C, and a 100 bet button 43D. It should be noted that in the case of an incorrect operation, the player may start again by touching a re-bet button 43E.

The player first specifies a bet zone in the bet area 41 so as to place a bet using a cursor 47 by directly pressing the screen with a finger or the like. At this time, pressing the 1 bet button 43A allows for betting one chip at a time (number of chips to be bet increases one by one in the order of 1, 2, 3, . . . every time the 1 bet button 43A is pressed). Similarly, pressing the 5 bet button 43B allows for betting five chips at a time (number of chips to be bet increases by five in the order of 5, 10, 15, . . . every time the 5 bet button 43B is pressed), pressing the 10 bet button 43C allows for betting ten chips at a time (number of chips to be bet increases by ten in the order of 10, 20, 30, . . . every time the 10 bet button 43C is pressed), and pressing the 100 bet button 43D allows for betting one hundred chips at a time (number of chips to be bet increases by a hundred in the order of 100, 200, 300, . . . every time the 100 bet button 43D is pressed). The number of chips bet up to the current time is displayed as a chip mark 48 in the bet area 41. The number displayed on the chip mark 48 indicates the number of bet chips.

In addition, the number of bet chips and payout credit count for a player in a previous game are displayed in the payout result display area 45. The number calculated by subtracting the number of bet chips from the credit count is a newly acquired credit count for the player in the previous game.

Moreover, a player's current credit count is displayed in the credit count display area 46. The credit count decreases according to the number of bet chips (1 credit count for 1 chip) when the player bets chips. If the bet chips are entitled to an award, the credit count increases in accordance with the number of paid out chips. It should be noted that the game is over when the player's credit count becomes zero.

A bet timer bar graph 49 is provided at the top of the first bet screen 40. The bet timer bar graph 49 indicates the allowable time left for a player to place a bet. At the beginning of a game, a red bar starts running gradually toward the right, and when it reaches the extreme right position, the allowable time for placing a bet in the current game concludes. When the player's betting time is up in each player terminal 4, the dice D1 to D3 are thrown out sequentially from the dice releasing unit 3*a* toward the rotary plate 3*b*.

The bet area 41 in the first bet screen 40 is described next. The bet area 41 has multiple bet zones in which chips are placed for betting.

As shown in FIG. 7, bet zones 41A and 41B are where a player places a bet on a predicted sum of dots to appear on the tops of the dice D1 to D3. In other words, the player selects the bet zone 41A if the predicted sum falls in a range of 4 to 10, or the bet zone 41B if the predicted sum falls in a range of 11 to 17. Odds are set to 1:1 (two chips are paid out for one bet), and if the sum is 3 or 18 (dots appearing on the tops of the dice are 1, 1, 1 or 6, 6, 6), the player loses the game.

A bet zone 41C is where a player places a bet, predicting that two of the three dice sequentially released have a same number of dots. In other words, the player wins an award if one of the combinations occurs, such as (1, 1), (2, 2), (3, 3), (4, 4), (5, 5), and (6, 6), and odds are set to 1:10.

A bet zone 41D is where a player places a bet, predicting that all three dice sequentially released have a same number of dots. In other words, the player wins an award if one of the combinations occurs, such as (1, 1, 1), (2, 2, 2), (3, 3, 3), (4, 4, 4), (5, 5, 5), and (6, 6, 6), and odds are set to 1:30.

A bet zone 41E is where a player places a bet on a predicted number of dots to appear commonly on all three dice sequentially released. In other words, the player places a bet on one of the combinations of (1, 1, 1), (2, 2, 2), (3, 3, 3), (4, 4, 4), (5, 5, 5), or (6, 6, 6), and odds are set to 1:180.

A bet zone 41F is where a player places a bet by predicting a total, a summation of dots to appear on the three dice sequentially released. Odds are set according to the occurrence probability of the total. For example, if the total is 4 or 17, odds are set to 1:60; if the total is 5 or 16, odds are set to 1:30; if the total is 6 or 15, odds are set to 1:18; if the total is 7 or 14, odds are set to 1:12; if the total is 8 or 13, odds are set to 1:8; if the total is 9 or 12, odds are set to 1:7; and if the total is 10 or 11, odds are set to 1:6.

A bet zone 41G is where a player places a bet on predicted numbers of dots to appear on two of the three dice sequentially released, and odds are set to 1:5.

A bet zone 41H is where a player places a bet on a number of dots to appear on the dice sequentially released, and odds are set according to the number of dice matching the predicted number of dots. A description is given of a case where the player places a bet on the predicted number of dots, '1' for example: odds are set to 1:1 if a single '1' appears on one of the three dice; odds are set to 1:2 if two '1's appear on two dice; and odds are set to 1:10 if three '1's appear on three dice.

Next, the second bet screen 60, which a player selects by operating the display selection button 42 in the first bet screen 40, is described.

Figure 1:
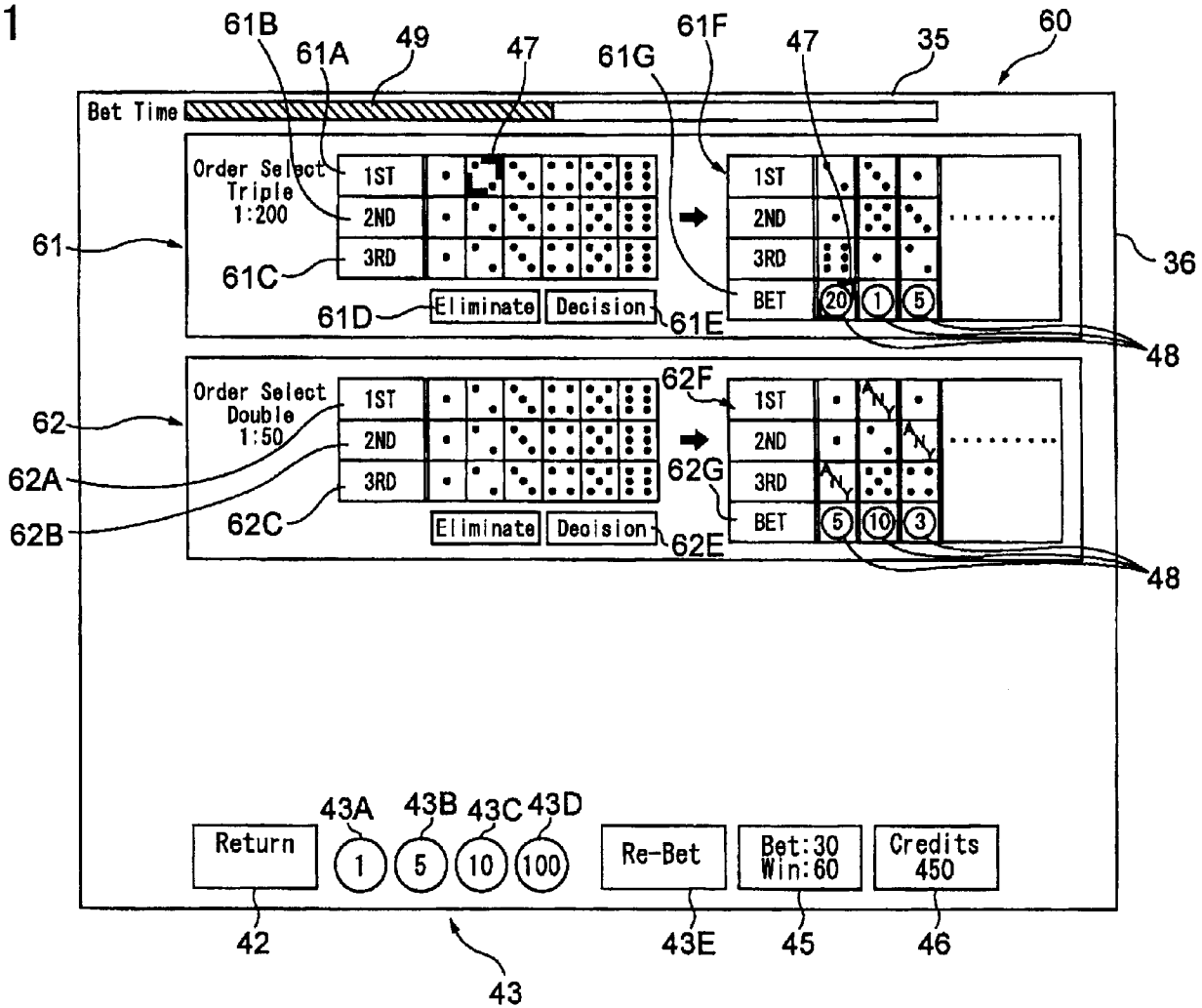
FIG. 1 is a diagram showing an exemplary display of a bet screen that allows betting by order of the release of dice (second bet screen)

FIG. 1 is a diagram showing an example of the second bet screen 60, which is displayed through selection by the player. It should be noted that the same reference numerals are provided for display areas of the second bet screen 60, which functionally similar to those of the first bet screen 40, and a detailed description thereof is not repeated.

The second bet screen 60 is mainly configured with two bet areas 61 and 62. The player selects a bet area by touching the touch panel 35, and places a bet with chips displayed in the selected area.

Similar to the first bet screen 40, a display selection button 42 for switching to the first bet screen 40, a bet button unit 43, a payout result display area 45, and a credit count display area 46 are displayed at the bottom of the second bet screen 60 in order from the left side of the screen.

In the bet area 61, the player places a bet by predicting an order of dice to be released and dots to appear on the top of each die. The player predicts respective dots for a first-released die (1st die), a second-released die (2nd die), and a third-released die (3rd die).

More specifically, the player determines the predicted dots to appear on the top of the 1st die, for example, by directly touching the dots selected from an area 61A where the six types of dots applicable to the 1st die are displayed, specifying the dots with a cursor 47, and touching a decision button 61E. The selection result is displayed in an area 61F at the right side of the bet area 61 (a display example of predicted dots '2' is given). Similarly, the predicted dots to appear on the 2nd die are determined using an area 61B. The selection result is displayed in the area 61F (a display example of predicted dot '1' is given). Similarly, the predicted dots to appear on the 3rd die are determined using an area 61C. The selection result is displayed in the area 61F (a display example of predicted dots '6' is given). It should be noted that touching a delete button 61D during selection allows for cancellation of selection or reselection of dots.

The selection results of the dots to appear on the tops of the three dice sequentially released are displayed in the area 61F at the right side of the bet area 61, and chips to be bet are displayed accordingly. When the player manipulates the bet button unit 43 while touching a corresponding bet area 61G to specify the particular area with the cursor 47, a chip mark 48 indicating the number of bet chips is displayed. It should be noted that if the player wants to place a bet on plural outcomes, it is possible for her to repeat the aforementioned steps (placing bets on three outcomes are illustrated in the display example of the drawing).

Prediction of the respective dots to appear on the tops of the dice sequentially released is meant to select one out of 216 combinations, where the winning probability is 1/216 and odds are set to 1:200.

It should be noted that in the first bet screen 40 where the aforementioned selection with respect to the order of the dice to be released is not performed, the only bet area having such winning probability is the bet zone 41E (where the player places a bet by predicting a same number of dots to appear on each of the three dice). However, since in the second bet screen 60 where the player selects the dots to appear on the tops of the dice with respect to their order of release, there are 216 combinations, she may have a chance to participate in more challenging selection with a high return, which encourages her to feel more enjoyable in the game.

In addition, the bet area 62 is where a player places a bet on dots to appear on the tops of the dice in combination with their order of release. Namely, the player predicts the dots to appear on the two dice selected from three.

More specifically, the player determines first predicted dots to appear on the top of the 1st die, for example, by directly touching the dots selected from a zone 62A where the six types of dots applicable to the 1st die are displayed, specifying the dots with the cursor 47, and touching a decision button 62E. The selection result is displayed in a zone 62F at the right side of the bet area 62 (a display example of predicted dot '1' is given). Similarly, the player determines second predicted dots to appear on the top of the 2nd die with a zone 62B. The selection result is displayed in the zone 62F (a display example of predicted dot '1' is given). It should be noted that since the 3rd die is not intended for selection, all the dots 1 to 6 are regarded as valid when selection of two dice has been completed ('ANY' is displayed). In the above exemplary description, it is assumed that the 3rd die is a die not to be intended for selection.

The selection results of the dots to appear on the tops of the two dice with respect to their order of release are displayed in the zone 62F at the right side of the bet area 62, and bet chips are displayed accordingly. In other words, manipulation of the bet button unit 43 while touching a corresponding bet zone 62G to specify the particular zone using the cursor 47, allows a display of a chip mark 48 indicating the number of bet chips. It should be noted that when the player wants to place bets on plural outcomes, it is possible for her to repeat the aforementioned steps (placing bets on three outcomes is displayed in the display example of FIG. 1).

When the dots to appear on the tops of the two dice in combination with the order of their release are predicted, the winning probability is 6/216 and odds are set to 1:50.

It should be noted that in the first bet screen 40 where the aforementioned selection with respect to the order of release is not performed, the bet areas with such winning probability are restricted to: the bet zone 41D (an area in which the player places a bet by predicting that the same dots will appear on all three dice); and the bet zone 41F in which the player places a bet by predicting that the total number of dots to appear on the dice will be 5 or 16. However, there are 108 combinations in the second bet screen 60 where the dots to appear on the dice are selected with respect to the order of their release. Since the player has a chance of participating in a more challenging game with a higher return, she feels more excited in the game.

Figure 8:
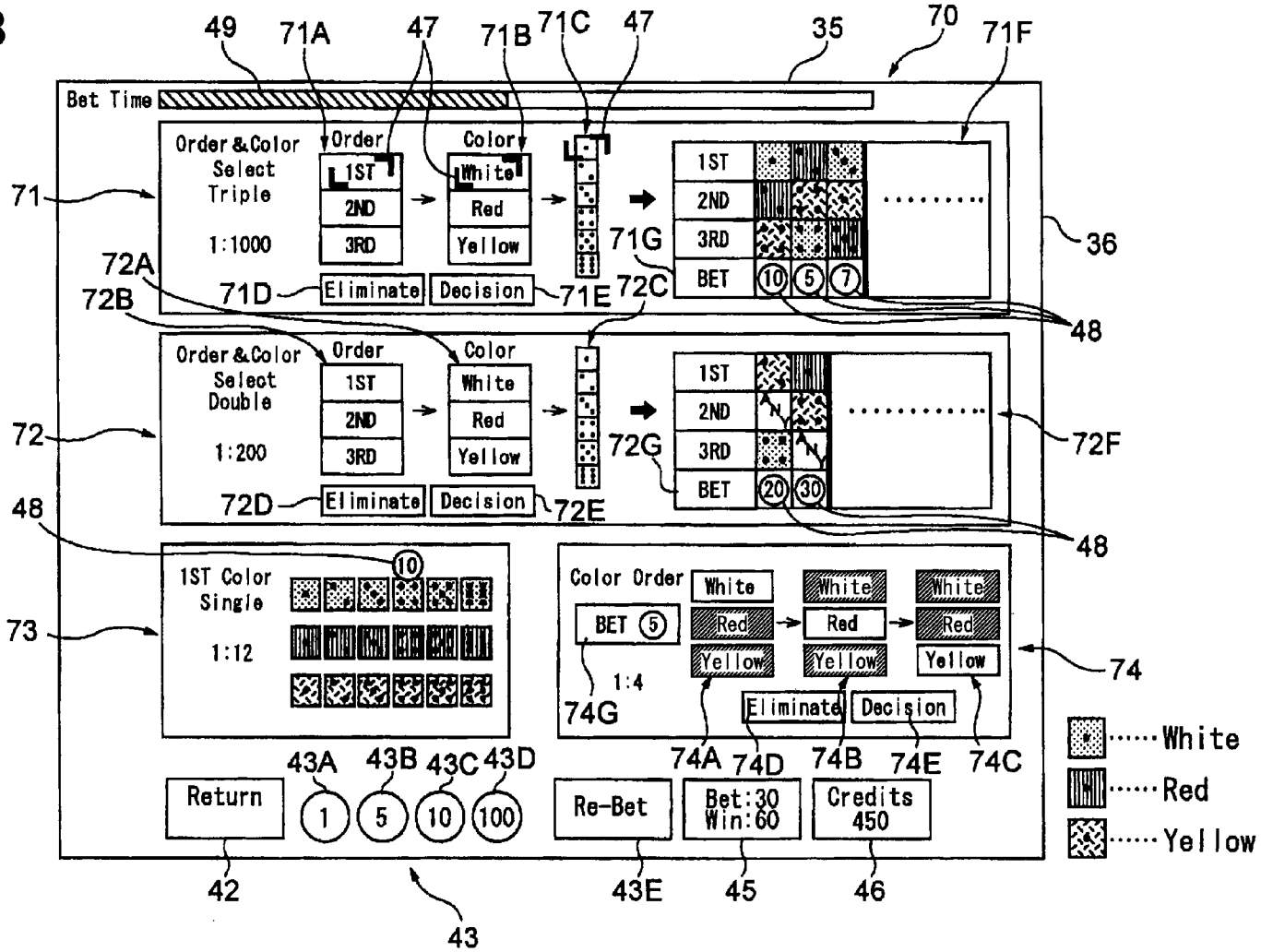
FIG. 8 is a diagram showing an exemplary display of a bet screen that allows betting by order of the release of dice and color (third bet screen)

FIG. 8 is a diagram illustrating an example of the third bet screen. It should be noted that display areas of the third bet screen 70, which are functionally similar to those of the bet screen 40, are denoted with the same reference numerals and are not described in detail.

As described above, in this embodiment, three dice differ in colors so that an order of the released dice can clearly be recognized by a player (so that the types of the dice can be comprehended). For this reason, it is possible to provide a bet area, in which a player can place a bet on the colors of the dice in addition to the above-described order of the dice to be released. In this case, there are 1296 combinations for the three dice, taking into account the order of the released dice, their colors, and dots to appear on the tops of the dice. In this way, the additional bet area that is more challenging allows the player to feel more excited. Furthermore, since the winning probability is low, it is possible that the bet area is arranged to yield a much higher payout.

A description is given of an example of a bet table through which a player places a bet on an order of dice to be released, their colors, and dots to appear on the dice, with reference to FIG. 8.

The third bet screen 70 is mainly configured with three bet areas 71, 72, and 73. The player selects a bet area by touching the touch panel 35, and performs betting with chips displayed in the selected area.

Similar to the first bet screen 40, a display selection button 42 for switching to the first bet screen 40, a bet button unit 43, a payout result display area 45, and a credit count display area 46 are displayed at the bottom of the third bet screen 70 in order from the left side of the screen.

In the bet area 71, a player places a bet by specifying an order of the dice to be released, their colors, and dots to appear on each die. The player predicts the respective dots and colors for a first-released die (1st die), a second-released die (2nd die), and a third-released die (3rd die).

Specifically, the player selects the 1st die by touching "1ST" and pointing with the cursor 47. The player touches a color selected from a color zone 71B displaying colors of the dice, and points the selected color with the cursor 47. Subsequently, the player touches dots selected from a dot zone 71C displaying types of dots, and points the selected dots with the cursor 47. Subsequent to these steps, the player touches a decision button 71E so as to determine the color and the dots for the 1st dice. The result of the selection described above is displayed in a zone 71F at the right side of the bet area 71.

The player completes an action of placing a bet by performing the similar steps described above for the dice which are released second and third. It should be noted that, the player can cancel the selection of the dots or perform a new selection by touching a delete button 71D.

The selection results for an order of the release of three dice, their colors, and the dots to appear on the tops of the dice are displayed in the zone 71F at the right side of the bet area 71. They are displayed in the form of dice differing in colors, which are placed in 1ST to 3RD positions. In an example shown in FIG. 8, the color and the dots are predicted to be white and "1" for the first-released die, red and "2" for the second-released die, yellow and "4" for the third-released die.

Subsequently, the player determines the number of chips to bet for the selection described above. When the player manipulates the bet button unit 43 while touching a corresponding bet zone 71G to specify the particular zone with the cursor 47, a chip mark 48 indicating the number of bet chips is displayed. It should be noted that if a player wants to place bets on plural outcomes, it is possible for her to repeat the aforementioned steps (placing bets on three outcomes are illustrated in the display example of the drawing).

Prediction of the colors and the respective dots to appear on the dice sequentially released is meant to select one out of 1296 combinations, where the winning probability is 1/1296 and odds are set to 1:1000.

As described above, the introduction of the bet area, in which the player places a bet on the order of the three dice to be released, their colors, and the dots, allows a higher payout which has not been realized by conventional dice games. In this way, the gaming machine according to this invention can allow the player to feel more excited in the game.

In addition, the bet area 72 is where a player places a bet on dots to appear on the tops of the dice in combination with their order of release and colors. Namely, the player predicts the dots to appear on the tops of the two dice selected from three.

More specifically, the player predicts a color and dots to appear on the 1st die in the following steps: selecting "1ST" from a zone 72A displaying the order of released dice, and pointing "1ST" with the cursor 47; selecting a color in a zone displaying the colors of dice, and pointing the selected color by the cursor 47; selecting dots in a zone 72C displaying the dots to appear on the tops of the dice, and pointing the selected dots with the cursor 47; and touching a decision button 72E. The selection result is displayed in a zone 72F at the right side of the bet area 72.

Similarly, the player performs another prediction for the 3RD die, and completes an action of placing a bet. It should be noted that the player can cancel the selection of the type of dots or perform a new selection by touching a deletion button 72D.

The selection result is displayed in the zone 72F at the right side of the area 72. It is displayed in the form of the dice differing in colors in combination with the order of their release. In an example shown in FIG. 1, yellow and the dots "2" are predicted for the die released first, and white and the dots "4" are predicted for the die released third. It should be noted that since the second-released die is not intended for selection, all the dots 1 to 6 are regarded as valid when selection of two dice has been completed ('ANY' is displayed).

Subsequently, the player determines the number of chips to bet for the selection described above. When the player manipulates the bet button unit 43 while touching a corresponding bet zone 72G to specify the particular area with the cursor 47, a chip mark 48 indicating the number of bet chips is displayed. It should be noted that if a player wants to place bets on plural outcomes, it is possible for her to repeat the aforementioned steps (placing bets on two outcomes are illustrated in the display example of the drawing).

The winning probability for the prediction of the colors and the respective dots to appear on the tops of the two dice is 1/1296, and odds are set to 1:200.

As described above, the introduction of the bet area, in which the player places a bet on the order of the two dice to be released, their colors, and the dots, allows a higher payout. In this way, the gaming machine according to this invention can allow the player to feel more excited in the game.

The bet area 73 is an area through which a player can place a bet on a color of a die released first and dots to appear on the top of the die. This bet area displays a total of eighteen dice of three groups differing in colors, each of which is composed of six dice. The player can select any die in this bet area by directly touching a die and pointing the particular die by the cursor 47. When the player subsequently operates the bet button unit 43, the number of bet chips is displayed as the chip mark 48.

The winning probability for the above-described prediction for the color of the first die and its dots is 1/18, and the odds are set to 1:12.

As described above, the three dice differing in colors allows the prediction for the color of the first-released die and the dots to appear on the tops of the die. In this way, the player can have more selections for placing a bet, and can be more excited.

The bet area 74 is an area through which a player can place a bet on the order of colors of dice to appear. The player can select the colors of the sequentially-released three dice by selecting colors in zones displaying the colors of the dice (1st die zone 74A, 2nd die zone 74B, and 3rd die zone 74C).

Specifically, the player can select white for the die to be released first in the following steps: touching "white" in the 1st die zone 74A; pointing "white" with the cursor 47; and touching a decision button 74E. In the 2nd die zone 74B, and the 3rd die zone 74C, "white" is turned off, so that selections in these zones are restricted to "red" and "yellow". When the player selects "red" in the 2nd die zone 74B, "yellow" is automatically selected in the 3rd die zone 74C. As shown in FIG. 8, an example of selection is shown for the case where "white", "red", and "yellow" are selected in the 1st die zone 74A, 2nd die zone 74B, and 3rd die zone 74C, respectively. When the player has finished the selection, she can see the number of bet chips as a chip mark 48, by touching a bet zone 74G, pointing with the cursor 47, and touching the bet button unit 43.

The winning probability for the above-described prediction for the order of three dice to appear is 1/6, and the odds are set to 1:4.

As described above, the three dice differing in colors allows the prediction for the order of three dice. In this way, the player can have more selections for placing a bet, and can be more excited.

Figure 9:
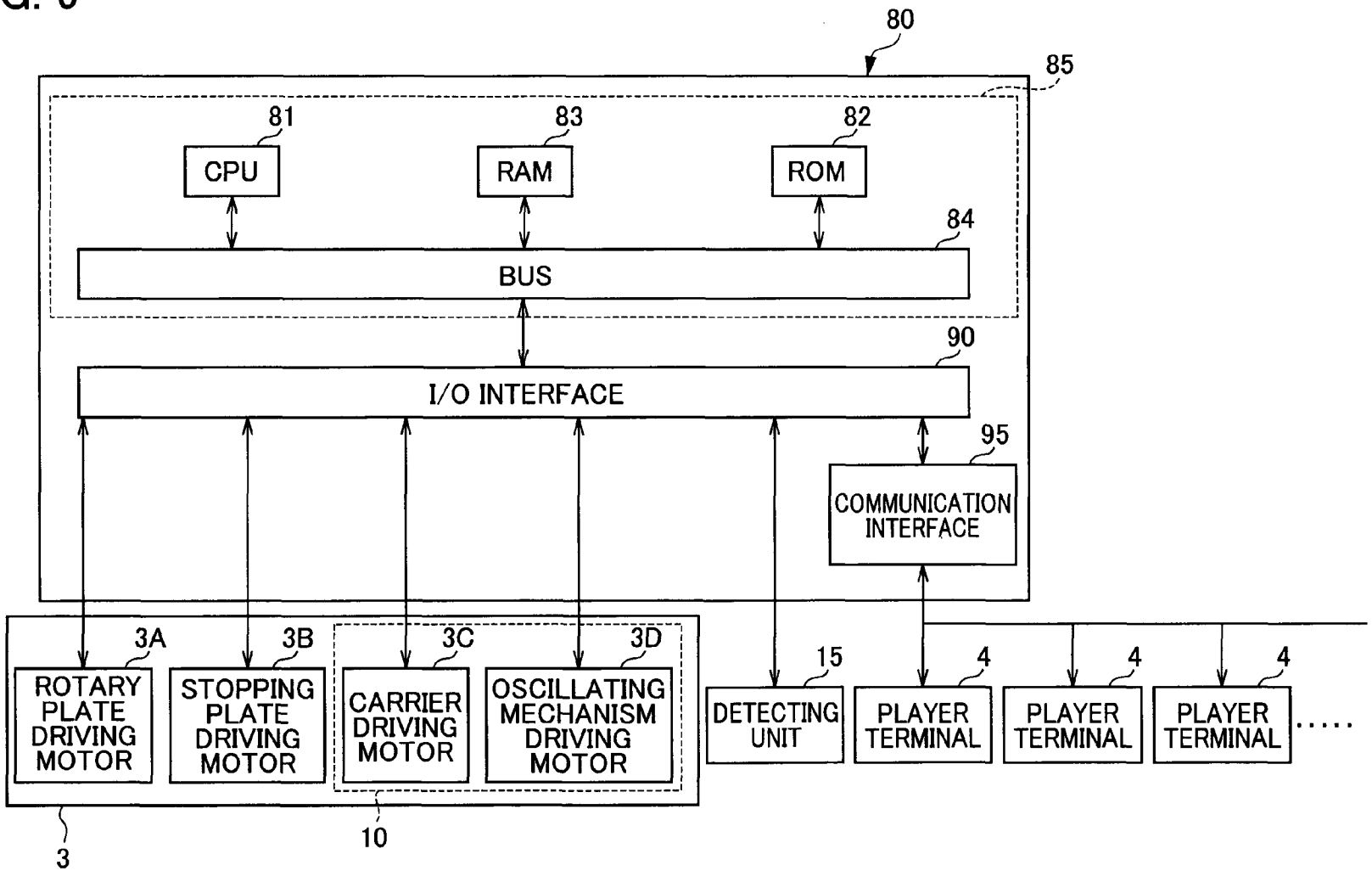
FIG. 9 is a block diagram schematically showing a control system of the gaming machine.

Next, a configuration of a control system of the gaming machine 1 is described while referencing FIG. 9. FIG. 9 is a block diagram schematically showing the control system of the gaming machine.

A main control unit 80 of the gaming machine 1 includes a microcomputer 85, which is configured with CPU 81 for main control, ROM 82, RAM 83, and a bus 84 that transfers data therebetween.

CPU 81 is connected to various devices which drive the game section 3, more specifically, the rotary plate driving motor 3A, the stopping plate driving motor 3B, the carrier driving motor 3C that serves as a main driving unit for the dice retrieve/release mechanism 10, the motor 3D for oscillating mechanism 10*d* and the like via an I/O interface 90. In addition, the aforementioned detecting unit 15 is connected to the I/O interface 90, and transmission and reception of a signal indicating the end of a game as well as signals indicating respective dots to appear on the top of the three dice resting on the stopping plate 3*c* is carried out therebetween. In addition, via a communication interface 95 connected to the I/O interface 90, the main control unit 80 transmits and receives data such as bet information, payout information, and the like to and from each player terminal 4.

ROM 82 in the main control unit 80 is configured with a semiconductor memory or the like, for example. ROM 82 stores a program for implementing basic functions of the gaming machine 1, more specifically, a program for controlling various devices which drive the game section 3, a program for controlling each player terminal 4, and the like, and a payout table referred to when playing the dice game.

RAM 83 is a memory, which temporarily stores various types of data calculated by CPU 81. The data includes, for example, bet information on chips transmitted from each player terminal 4, information related to the colors of dice and respective types of dots to appear on the dice sequentially transmitted from the detecting unit 15, data relating to the process results executed by CPU 81, and the like.

CPU 81 controls components to drive the game section 3, such as the rotary plate driving motor 3A, the stopping plate driving motor 3B, the carrier driving motor 3C, and the oscillating mechanism driving motor 3D, based on the data and programs stored in ROM 82 and RAM 83. In this way, CPU 81 controls processing associated with the progress of a game, such as throwing of the dice to the rotary plate 3*b* of the game section 3, carrying of the dice to the dice releasing unit 3*a* so as to allow for re-throwing of the dice retrieved from the stopping plate 3*c*, and checking of the dots to appear on the top of the dice resting on the stopping plate 3*c*.

In addition to the control of processing described above, CPU 81 executes a game by transmitting and receiving data to and from each player terminal 4 so as to control each player terminal 4. More specifically, CPU 81 receives bet information transmitted from each player terminal 4, and determines whether or not bet chips are entitled to awards based on the dots on the top of the dice and the received bet information. In this way, CPU 81 calculates a credit amount to be paid in each player terminal 4 by referring to the payout table.

Next, a configuration of a control system of the player terminal 4 connected to CPU 81 in the main control unit 80 is described.

Figure 10:
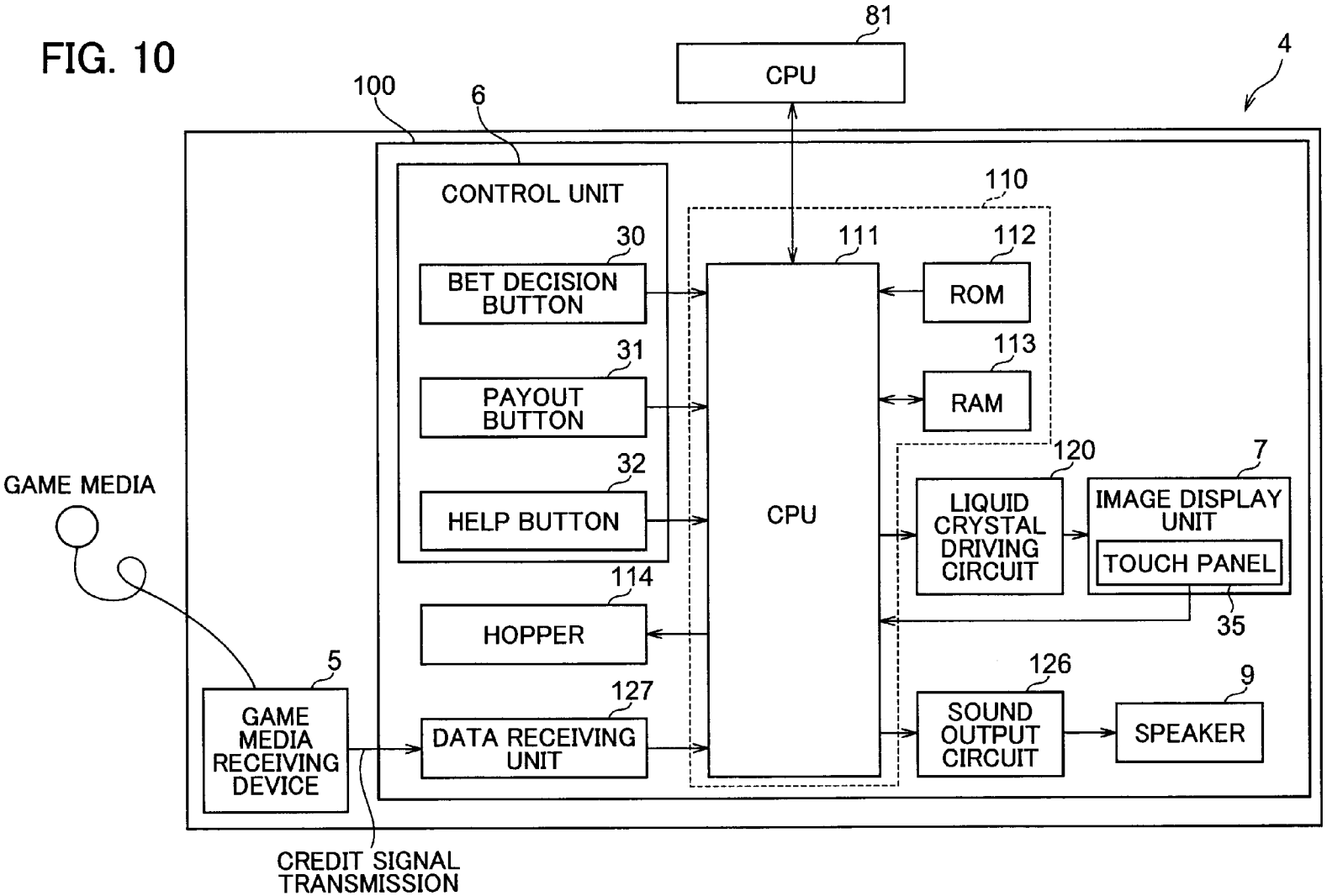
FIG. 10 is a block diagram schematically showing a control system of a player terminal.

FIG. 10 is a block diagram schematically showing the control system of the player terminal 4 according to this embodiment.

The player terminal 4 includes a main body 100 in which an image display unit 7 and the like are provided, and a game media receiving device 5, which is attached to the main body 100. The main body 100 further includes a player terminal control unit 110 and some peripheral devices.

The player terminal control unit 110 includes CPU 111 for controlling the player terminal 4, ROM 112, and RAM 113.

ROM 112, which is configured with semiconductor memory or the like, for example, stores a program for implementing basic functions of the player terminal 4, other various programs needed to control the player terminal 4, a data table, and the like.

RAM 113 is a memory temporarily storing various types of data calculated by CPU 111, player's current credit count, player's chip bet conditions, and the like.

Moreover, a bet decision button 30, a payout button 31, and a help button 32 provided in the control unit 6 (see FIG. 2) are connected to CPU 111, respectively. CPU 111 controls the execution of various operations in accordance with manipulation signals, which are generated in response to each button pressed by a player. More specifically, CPU 111 executes various processing, receiving input signals transmitted from the control unit 6*a* in response to player's manipulation, and the data and programs stored in ROM 112 and RAM 113. Subsequently, CPU 111 transmits the results to CPU 81 in the main control unit 80.

In addition, CPU 111 receives instruction signals from CPU 81, controls peripheral devices of the player terminal 4, and executes a dice game in the player terminal 4. Moreover, according to processing contents, CPU 111 executes various processing based on input signals transmitted from the control unit 6 in response to a player's manipulation, and the data and programs stored in ROM 112 and RAM 113. Along with the results acquired by the execution of processing, CPU 111 controls peripheral devices of the player terminal 4, and executes a dice game in the player terminal 4. It should be noted that which one of two types of processing is applied to each processing depends on the processing contents. For example, the former approach is applied to payout processing of game media for respective dots to appear on the tops of the dice, and the latter approach is applied to bet processing by a player.

Furthermore, a hopper 114, which is connected to CPU 111, pays out a predetermined number of game media through the payout slot 8, receiving the instruction signals from CPU 111.

Moreover, the image display unit 7 is connected to CPU 111 via a liquid crystal driving circuit 120. The liquid crystal driving circuit 120 includes program ROM, image ROM, an image control CPU, work RAM, a video display processor (VDP), video RAM, and the like. The program ROM stores various selection tables and an image control program for displaying on the image display unit 7. The image ROM stores, for example, dot data for forming images to be displayed on the image display unit 7. In addition, the image control CPU determines an image to be displayed on the image display unit 7 from the dot data previously stored in the image ROM according to the image control program previously stored in the program ROM based on parameters specified by the CPU 111. The work RAM is configured as a temporary storage means when executing the image control program by the image control CPU. The VDP forms an image corresponding to the display contents determined by the image control CPU and displays the resulting image on the image display unit 7. It should be noted that the video RAM is configured as a temporary storage means when forming an image by the VDP.

As mentioned above, the touch panel 35 is attached to the front side of the image display unit 7, and the information related to operation on the touch panel 35 is transmitted to CPU 111. The touch panel 35 detects a player's betting of chips on the first bet screen 40, the second bet screen 60, and the third bet screen 70. More specifically, selection of the bet area 41 in the first bet screen 40, the bet areas 61 to 64 in the second bet screen 60, and the bet areas 71 to 74 in the third bet screen 70, as well as manipulation of the bet button unit 43 and the like, are performed by touching the touch panel 35. The information related to the operation described above is transmitted to CPU 111. Based on the information, the current bet information of a player (the bet areas 41, 61 to 64, and 71 to 74 in the bet screens 40, 60, and 70 respectively, and the number of bet chips) is stored in RAM 113 as needed. In addition, the bet information is transmitted to CPU 81 in the main control unit 80, and stored in a bet information storage area in RAM 83.

Moreover, a sound output circuit 126 and a speaker 9 are connected to CPU 111. The speaker 9 emits various sound effects for performing various kinds of rendered effects, receiving output signals from the sound output circuit 126. In addition, the game media receiving device 5, into which game media such as coins or medals are inserted, is connected to CPU 111 via a data receiving unit 127. The data receiving unit 127 receives credit signals transmitted from the game media receiving device 5, and CPU 111 increases a player's credit amount stored in RAM 113 based on the transmitted credit signals.

Next, a description is given of operation of the gaming machine 1 configured as described above, and an exemplary game playing operation of a player in the player terminal 4.

With the gaming machine 1, once a player takes a seat at a player terminal 4, a game is performed in the game section 3 at constant intervals. When the player of the player terminal 4 inserts game media such as coins or medals into the game media receiving device 5, the number of chips (number of remaining chips) available for betting is accordingly displayed on the credit count display area 46 in the bet screens 40, 60 and 70 of the image display unit 7.

A player places a bet within the duration of the bet timer graph 49 displayed on the bet screens 40, 60 and 70. Accordingly, betting is accepted by the first bet screen 40, the second bet screen 60 and the third bet screen 70. These screens are switched through pressing (touching) operation of the display selection buttons 42A and 42B.

In the first bet screen 40, the player can place a bet according to typical SICBO rules. In other words, regardless of the types (colors) of the dice and the order of their release in the game section 3, the player can place a bet only on dots to appear on the tops of the dice, and she can place a bet in the bet zones 41A to 41G according to the aforementioned operation procedure. As illustrated in FIG. 7, chip marks 48 are displayed for the bets placed by the player.

In addition, if the player wants to place a bet on predicted dots to appear on the tops of the dice sequentially released in the game section 3, she can have a display of the second bet screen 60 shown in FIG. 1 by touching the display selection button 42A in the first bet screen 40.

In the second bet screen 60, a player can place a bet on the dots to appear on the tops of the dice to be sequentially released in the game section 3. The player can place bets in the bet areas 61 and 62 by the aforementioned operation procedure. As illustrated in FIG. 1, chip marks 48 are displayed for the bets placed by the player.

When a player desires to place a bet predicting the colors in combination with the order of appearance and dots for the dice, which are sequentially released in the game section 3, she touches the display selection section 42B of the first bet screen 40 to display the third bet screen 70 shown in FIG. 8.

In the third bet screen 70, a player can place a bet on the colors and dots to appear on the tops of the dice to be sequentially released in the game section 3. The player can place bets in the bet areas 71 to 74 by the aforementioned operation procedure. As illustrated in FIG. 8, chip marks 48 are displayed for the bets placed by the player.

The bet information from the above-described respective player terminals 4 is stored in a predetermined working area of RAM 83 of the main control unit 80. When a period of time allowed for a player to place a bet has elapsed, CPU 81 of the main controller unit 80 sends a drive signal to the game section 3. As a result, any of the dice D1 to D3 in three colors is released onto the rotary plate 3*b* rotationally driven in the game section 3. Subsequently, the dice are stopped and retrieved on the stopping plate 3*c* (these operations are repeated three times for each of the three dice). The detecting unit 15 detects the colors of the sequentially-released dice while they are resting on the stopping plate 3*c* so as to identify the colors of dice in combination with the order of their appearance.

The information related to the dots and colors of the dice is sent to the main control unit 80. Based on this information and bet information for each player terminal 4 stored in RAM 83, CPU 81 performs processing of award determination. When CPU 81 determines that there is an award, it calculates a payout, referring to a predetermined payout table. Then, the results of the processing, which are stored in a predetermined working area of RAM 83, are transmitted to each player terminal 4.

CPU 111 of each player terminal 4 controls the liquid crystal driving circuit 120, receiving a signal indicating award determination sent from the main control unit 80. CPU 111 also updates the payout result display area 45 and the credit count display area 46, which are displayed in the respective bet areas 40, 60 and 70. In addition, CPU 111 drives the liquid crystal driving circuit 120 and the sound output circuit 126 to provide rendered effects with images and sounds.

Accordingly, CPU 81 of the main control unit 80 drives the retrieve/release mechanism 10 so as to shuffle the three dice D1 to D3 stored in the receiving unit 10*a*. CPU 81 then controls the shuffled dice to be stored in the receiving unit 10*a* so as to advance a new game.

With the gaming machine 1 and the dice game using the gaming machine, a player predicts an order of appearance and types of dots for the different types of dice (three different colored dice), which tumble in the game section 3. The player can place a bet with the prediction at the player terminal 4 via the second bet screen 60. In other words, since the player can place a bet on predicted dots to appear on the tops of the multiple types of dice in combination with the order of their appearance, it is possible to increase the number of subjects for betting more than that of conventional dice games using dice of a single type. Furthermore, the player can have a chance to receive a payout with high return rate, so that it is possible to allow her to feel more excited.

Particularly, this embodiment, which realizes easy betting and simple rules by introducing a dice game similar to conventionally familiar SICBO, allows a player to feel comfortable when she participate in the game. In addition, since the player may easily recognize the order of dice released in the game section 3 and immediately recognize game results due to the three dice differing in colors, it is possible to allow the player to feel more interested in the game.

Furthermore, as shown in the third bet screen 70, this embodiment that allows the player to place a bet on the colors of the dice as well as the order of their appearance. For this reason, the embodiment increases types of bets. Compared with the conventional SICBO that merely allows a player to roll three dice and predicts dots to appear on the tops of the dice, the gaming machine according to the present invention can provide another bet area yielding a higher payout rate. In this way, the gaming machine allows the player to feel more amused in the game.

Furthermore, in the above-described embodiment, the order and colors of released dice are specified in the dice releasing unit 3*a*. Accordingly, the gaming machine can simultaneously tumble and stop the three dice in the game section 3, which results in a reduction in time required of a game. Furthermore, the use of released dice having different colors can also allow the player to easily recognize the order of their release.

Embodiments of the gaming machine and a method of controlling a dice game of the present invention are described above; however, the present invention is not limited to the aforementioned embodiments, and can be modified in various ways.

For example, in the game section 3, it may be possible to modify a method of tumbling and stopping dice, a method of specifying the order of released dice, a method of determining dots that appear on tops of dice, a method of retrieving dice, and the like. For example, dice may alternatively be configured so as to tumble on a vibrating plate. It may be alternatively possible that the dice are sequentially released in the game section while the order of released dice is detected. Furthermore, it may be alternatively possible that the game section is configured to be partitioned into individual game portions, in which respective dice are individually tumbled. In other words, it may be possible that the gaming machine allows a player to place a bet according to the order of released dice tumbling in the individual game portions.

In addition, it may alternatively be possible to electronically simulate an image of tumbling and stopping dice by an image display unit instead of mechanically tumbling dice in the game section.

Furthermore, it may be possible to adopt an identifiable device pre-mounted in each die, a magnetically susceptible device, for example, such that a detecting unit detects dots that appear on the tops of dice. It may alternatively be possible to adopt an optical sensor so as to detect the dots.

Moreover, the number of dice to be used is not limited to three, and it may be two or four, or more. Furthermore, the type of dice may alternatively be distinguished by size rather than by color.

In addition, the method of placing a bet on predicted dots and the order of released dice may be variously changed in addition to a betting form shown in FIG. 1. For example, appropriate modifications, such as prediction of an order of dice to be released on which a same number of dots will appear, prediction of dots to appear on the tops of dice with respect to an order of their release arbitrarily selected by a player, and the like, are possible alternatives. Moreover, the odds for each bet area are merely examples, and may be appropriately modified according to geographical areas, regional regulations, or the like.

Furthermore, the present invention may be applied to a table game where a dealer simply handles dice.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A dice game controller method implemented by a computer programmed as a dice game controlling apparatus for controlling operation of a dice game, the method comprising:

(a) sequentially rolling, by a dice releasing unit, a plurality of dice, wherein the plurality of dice are visually distinguishable from each other;

(b) allowing a player, via a player terminal, to place bets on predicted dots to appear on tops of the plurality of dice in combination with an order of appearance of the plurality of dice and the predicted dots to appear on the tops of the plurality of dice in combination with types of the plurality of dice;

(c) receiving, from the player terminal, a signal indicative of a bet placed on the predicted dots to appear on the tops of the plurality of dice in combination with the order of appearance of the plurality of dice;

(d) receiving, from the player terminal, a signal indicative of a bet placed on the predicted dots to appear on the tops of the plurality of dice in combination with the types of the plurality of dice;

(e) causing, by a game section, the plurality of dice sequentially rolled by the dice releasing unit to rest;

(f) distinguishing, by a sensing portion of the dice releasing unit, the types of the plurality of dice caused to rest by the game section; and (g) providing a predetermined award to the player when one or more of the bets placed in (b) is entitled to the award.

2. A gaming machine for a dice game, comprising:

a dice releasing unit that sequentially releases a plurality of dice, wherein the plurality of dice are visually distinguishable from one another;

a game section having a stopping plate that causes the plurality of dice released from the dice releasing unit to rest;

a player terminal having a display through which a player can place a bet on predicted dots to appear on tops of the plurality of dice resting on the stopping plate in combination with an order of release of the plurality of dice and types of the plurality of dice; and a controller configured with logic to (i) control the dice releasing unit to release the plurality of dice, (ii) control the player terminal so as to perform a bet operation, and (iii) control a payout of game media in accordance with an award, wherein the controller receives, from the player terminal, a signal indicative of placing a bet on the predicted dots in combination with the order of release of the plurality of dice and a signal indicative of placing a bet on the predicted dots to appear on the tops of the plurality of dice in combination with the types of the plurality of dice, and wherein the dice releasing unit includes a sensing portion that distinguishes the types of the plurality of dice sequentially released.

3. The gaming machine according to claim 2, further comprising a detecting unit that detects dots to appear on the tops of the respective types of dice resting on the stopping plate, wherein the controller executes payout processing for the player terminal in accordance with the dots detected by the detecting unit.

4. A non-transitory computer-readable medium encoded thereon with a program that, when executed by a computer, causes the computer to perform a method of controlling a dice game, the method comprising:

(a) sequentially rolling a plurality of dice, wherein the plurality of dice are visually distinguishable from one another;

(b) allowing a player to place bets on predicted dots to appear on tops of the plurality of dice in combination with an order of appearance of the plurality of dice and types of the plurality of dice;

(c) receiving a signal indicative of placing a bet on the predicted dots to appear in combination with the order of appearance of the plurality of dice;

(d) receiving a signal indicative of placing a bet on the predicted dots to appear in combination with the types of the plurality of dice;

(e) causing the plurality of dice sequentially rolled in (a) to rest;

(f) distinguishing the types of the plurality of dice caused to rest in (e); and (g) providing a predetermined award to the player when one or more of the bets placed in (b) is entitled to the award.

* * * * *